US006109568A

United States Patent [19]

Gilbert et al.

[11] Patent Number: 6,109,568

[45] Date of Patent: Aug. 29, 2000

[54] CONTROL SYSTEM AND METHOD FOR MOVING MULTIPLE AUTOMATED VEHICLES ALONG A MONORAIL

[75] Inventors: Chris Brian Gilbert, Aurora; Bernd Hillebrecht, Morrison, both of Colo.

[73] Assignee: Innovative Transportation Systems International, Inc., Morrison, Colo.

[21] Appl. No.: 09/178,379

[22] Filed: Oct. 23, 1998

[51] Int. Cl.[7] ..... B61L 27/00

[52] U.S. Cl. ..... 246/3; 246/2 R; 246/5; 246/167 R; 104/88.03

[58] Field of Search ..... 246/2 R, 3, 5, 246/167 R, 182 R; 340/933, 988, 989; 701/1, 2, 19, 20, 23, 24; 104/88.01, 88.02, 88.03, 88.04, 88.05, 295, 296, 300

[56] References Cited

U.S. PATENT DOCUMENTS

| | | | |
|---|---|---|---|
| 4,735,383 | 4/1988 | Corrie | 246/3 |
| 4,884,208 | 11/1989 | Marinelli et al. | 340/989 |
| 5,012,749 | 5/1991 | Passage, Jr. . | |
| 5,592,883 | 1/1997 | Andress | 104/88.03 |

OTHER PUBLICATIONS

Micron Communications, Inc., Micron 125 kHz Readers, Catalog (no date).

Micron Communications, Inc., Small Disk Asset Tag, Catalog (no date).

Micron Communications, Inc., Micron 125 kHz External RFID Antenna, Catalog (no date.

Sunx Trading Co., Ltd., Obstacle Detection Sensor PX–2 Series, Instruction Manual, Japan (no date).

Rockwell Automation Allen–Bradley, Connect to the Future Today with Allen–Bradley's SLC 5/05TM Processor with Ethernet, Catalog, Nov. 1997, Publication 1747–1.18, USA.

Symbol Technologies, Inc., Spectrum 24 Wireless LAN, Dec. 1997, Part No. DJ, USA.

*Primary Examiner*—Mark T. Le

*Attorney, Agent, or Firm*—Dorr, Carson, Sloan & Birney, P.C.

[57] ABSTRACT

The monorail system of the present invention contains a monorail and a system controller that has a first radio frequency ethernet communications device. Location markers are attached to the monorail. A vehicle is positioned to move on the monorail. The vehicle contains a motor drive system that moves the vehicle on the monorail. A remote controller is interconnected to the motor drive system, and the remote controller controls movement of the vehicle and receives information from the system controller. A reader connected to the remote controller senses the location markers attached to the monorail. A second radio frequency ethernet communications device is provided and is connected to the remote controller. The radio frequency ethernet communications device wirelessly communicates with the first radio frequency ethernet communications device on the system controller to create a wireless ethernet network containing at least the system controller and the remote controller. The information from the system controller is delivered over the wireless ethernet network to the vehicle, and the information is used to instruct the vehicle in the controlled movement on the monorail.

21 Claims, 8 Drawing Sheets

Location Marker Sensed ?
No
510
Transmit Location information to System Controller
522
Has Program Changed ?
512
Yes
No
Location marker match an entry on the Program List?
516
Yes
No
Transmit "Error" Message to System Controller
518
Perform task associated with Location Marker.
520

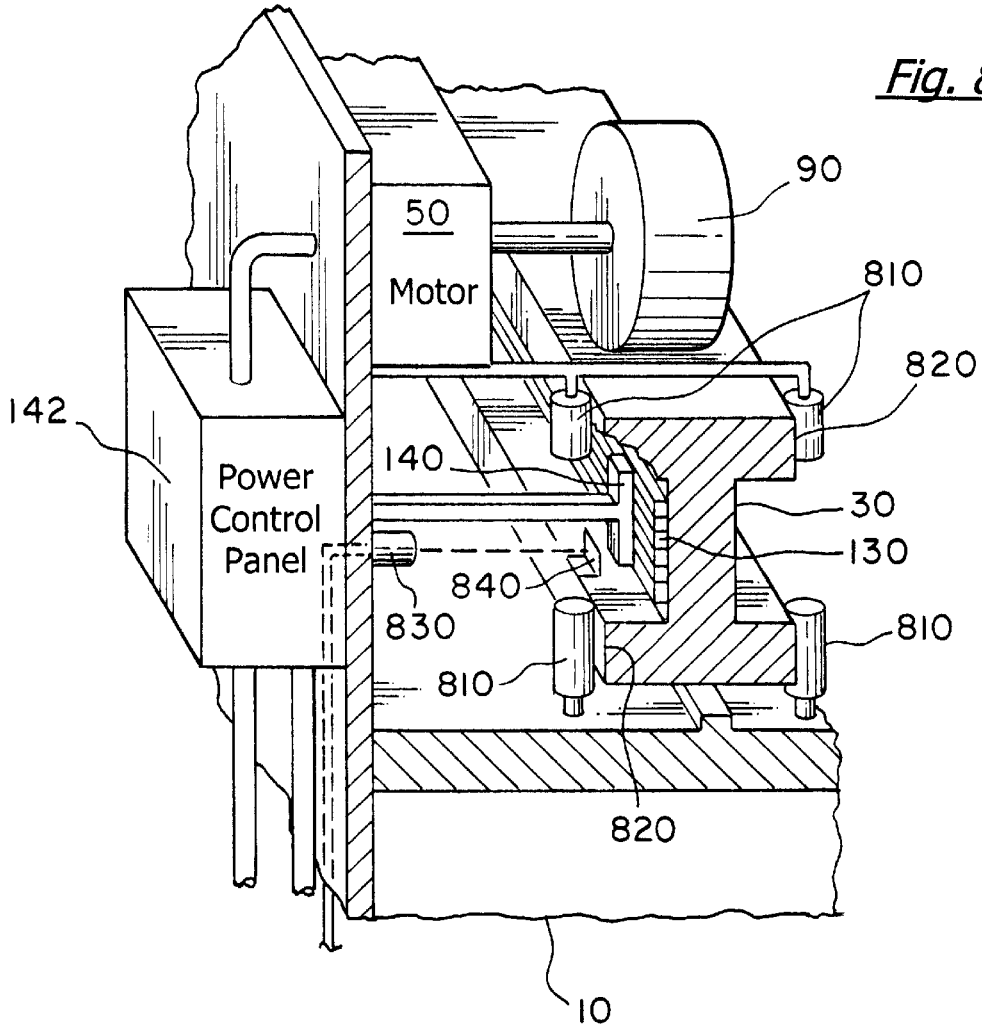
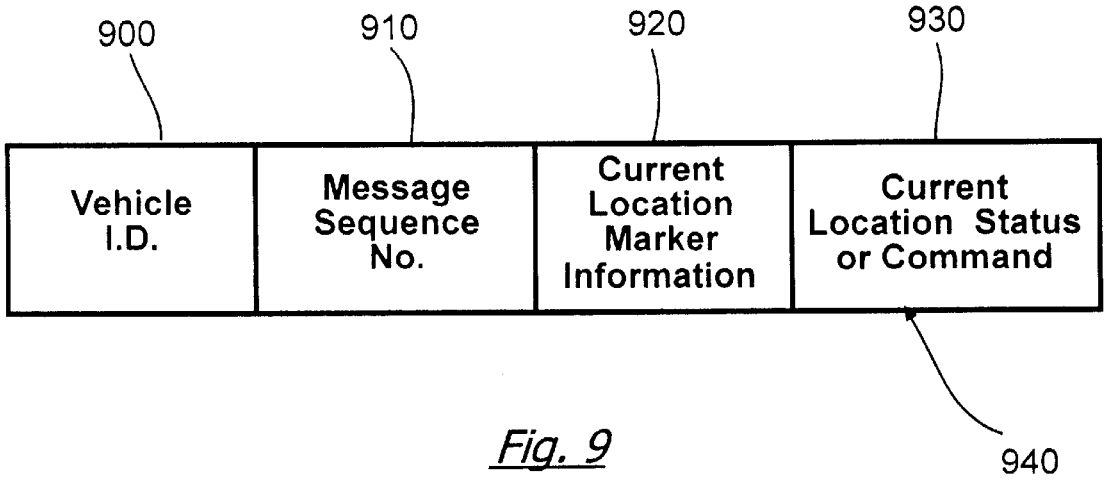
Fig. 9

CONTROL SYSTEM AND METHOD FOR MOVING MULTIPLE AUTOMATED VEHICLES ALONG A MONORAIL

BACKGROUND OF THE INVENTION

1. Field of the Invention

The present invention relates generally to moving multiple automated vehicles, and, more particularly, to a control system and method for moving an automated vehicle along an automated electrified monorail under central control.

2. Statement of the Problem

Conventional automated electrified monorail (AEM) systems, typically, contain a monorail, a number of vehicles that move along the monorail and control electronics that control the movement of the vehicles along the monorail. The monorail is an industry standard rail having an I-type cross section. In most applications, the monorail is installed overhead on a beam or suspended from the ceiling. This overhead configuration allows the vehicles to move along the monorail and perform tasks without being impeded by obstacles located at the floor level.

The vehicles contain a suspension system that connects the vehicle to the monorail. The suspension system contains wheels that contact and move along the monorail. Typically, an electric motor is attached to the wheels to propel the vehicle along the monorail. The electrical power for the motor is provided by a number of bus-bar-type power conductors that are hardwired and physically attached along the perimeter of the monorail. Typically, electrical power is provided by four power conductors (three-phase power and a ground wire). The motor contains electrical connectors that provide electrical contact to the power conductors as the vehicle travels along the monorail.

The conventional AEM system has electronic control equipment that is used to instruct the vehicle to move along the monorail. The control equipment usually contains a number of bus-bar-type control conductors that are hardwired and physically attached along the perimeter of the monorail with the power conductors. Typically, conventional AEM systems require about eight to twelve conductors for controlling and powering the vehicles. A predetermined number of the control conductors are used to control the movement and speed of the vehicle while the other conductors may be used to control the vehicle while performing a variety of other functions. At a first end, the control conductors are connected to a system controller that determines the voltage that is to be applied to the control conductors. Along the length of the monorail, the control conductors make contact with the vehicle electronics which contain electrical connectors that electrically contact the control conductors as the vehicle moves along the monorail.

In these systems, the vehicle control electronics are typically hardwired on the vehicle. The control electronics provide vehicle control by interpreting the voltage applied to the control conductors. This interpreted voltage is translated into an applied motor voltage. Accordingly, the electric motor moves the wheels corresponding to this applied motor voltage.

When the vehicles are required to change speeds, for example around curves or known obstacles, these conventional AEM systems require physical cuts in the control conductors, thereby providing movement zones having a specific voltage. Such movement zones are created by physically cutting the control conductors into separate electrically isolated sections. Each section becomes a movement zone and must be separately connected to the system controller which controls the voltage applied to the conductors in the zone.

Installation of conventional AEM systems is typically expensive and labor intensive because these systems require eight to twelve conductors including control and power conductors to be manually installed and routed along the perimeter of the monorail. In addition to the installation expenses, the creation of movement zones on the monorail also are labor intensive and expensive requiring manually cutting and electrically isolating the section conductors at specified locations along the monorail and connecting each separate section to the system controller. After installation, modification of the AEM system, particularly moving the movement zones from one location to another, is difficult because the hardwired conductors must each be disconnected from the system controller and reconnected at the new location. However, if the size of the monorail is changed, all the control conductors must be removed and reinstalled since these conductors have been physically cut to create the movement zones.

Additionally, aside from moving the monorail, relocation of the movement zones on an existing monorail presents a variety of problems. Since the control conductors have been physically cut to create movement zones, any relocation of these zones on an existing monorail requires removal of the old conductors and installation of new conductors. In addition, the new conductors must be physically cut and electrically isolated to create the movement zones newly desired location. The modification and installation of the conventional AEM systems can become even more expensive if the AEM system is installed or modified in an enclosed structure that has many obstacles to restrict the movement of the installation workers. Furthermore, this modification is expensive due to the high cost of the materials (wires, cables and cable trays) and due to the labor time that is required to make the modification.

Also, in conventional AEM systems, the control electronics use discrete signals which limit the amount of data that is capable of being transmitted over the control conductors. Accordingly, to increase the amount of data that can be transmitted, the conventional AEM systems require that additional control conductors be added to the monorail. These additional conductors also require labor intensive and expensive installation and modification.

Another problem with conventional AEM systems is found in the hard-wired vehicle control electronics. Since the vehicle control electronics are hardwired to the vehicle, the AEM system must be shut down or the vehicle must be removed from the monorail to reprogram the control electronics. Reprogramming is typically accomplished by physically changing the hard-wired electronics or by changing the program located in memory in a vehicle controller. In either case, the vehicle must be physically stopped for the change to occur.

Finally, conventional AEM systems are equipped with collision devices containing proximity sensors that are located on an arm extending from the vehicle. These proximity sensors prevent the vehicles from colliding during movement on the monorail. These conventional collision devices have a detection range that is limited to the length of the arm on which the proximity sensor is positioned.

Therefore, a need exists for an AEM system that is easier and less expensive to install than present systems, and an AEM system that is readily adaptable to change and modification. In addition, a need exists for an AEM system that allows for uncomplicated physical relocation or modification of the movement zones. A need exists for an AEM system that communicates significantly more data that conventional systems. Also, there is a need for an AEM system that allows for vehicle program changes that do not require the entire AEM system to be shut down or vehicles to be removed from the monorail. Finally, a need exists for a vehicle having a collision avoidance system where the detection range is not dependent upon the length of a sensor arm.

SUMMARY OF THE INVENTION

1. Solution to the Problem.

The problems mentioned above and other problems are solved by the present invention. The present invention provides a monorail system that is less expensive and easier to install than present systems because the present invention does not require the installation of separate and costly control conductors. The present invention provides a novel movement zone that eliminates the expense associated with physically cutting the control conductors into movement zones and therefore allows the movement zones to be easily relocated. The present invention also provides an AEM system that can be physically moved or modified easier than existing monorail systems which have control conductors and the problems associated with the control conductors. In addition, the present invention provides a system where the programming of the vehicle control electronics can be changed without shutting down the AEM system or removing the vehicles from the monorail.

Further, the present invention provides an AEM system that does not severely limit the amount of data that can be transmitted to the vehicles. The present invention also provides a novel AEM system that uses vehicles equipped with collision avoidance devices to avoid collisions with other vehicles or objects positioned on the monorail and objects that are not positioned on the monorail. Further, the collision avoidance system of the present invention has a programmable detection range. Finally, the AEM system of the present invention processes significantly more data between the central controller and the vehicle.

2. Summary

The monorail system of the present invention contains a monorail and a system controller that has a first radio frequency ethernet communications device. Location markers are attached to the monorail to define movement zones and areas where specific tasks, are performed. A vehicle is positioned on the monorail under the control of a motor drive system that moves the vehicle on the monorail. A remote controller is interconnected to the motor drive system, and the remote controller controls movement of the vehicle based on the delivery of high speed information received from the system controller. A reader connected to the remote controller senses each location marker attached to the monorail as the vehicle moves on the monorail. A second radio frequency ethernet communications device is provided and is connected to the remote controller. The radio frequency ethernet communications device wirelessly communicates with the first radio frequency ethernet communications device on the system controller to create a wireless ethernet network containing at least the system controller and the remote controller. The information from the system controller is delivered over the wireless ethernet network to the vehicle, and the information is used to instruct the vehicle in the controlled movement on the monorail.

BRIEF DESCRIPTION OF THE DRAWINGS

FIG. 8 is a perspective view illustrating the arrangement of the vehicle of the present invention with the monorail;

FIG. 9 sets forth the data sequence that is useful in accordance with the present invention;

DETAILED DESCRIPTION OF THE INVENTION

1. Overview

Figure 1:
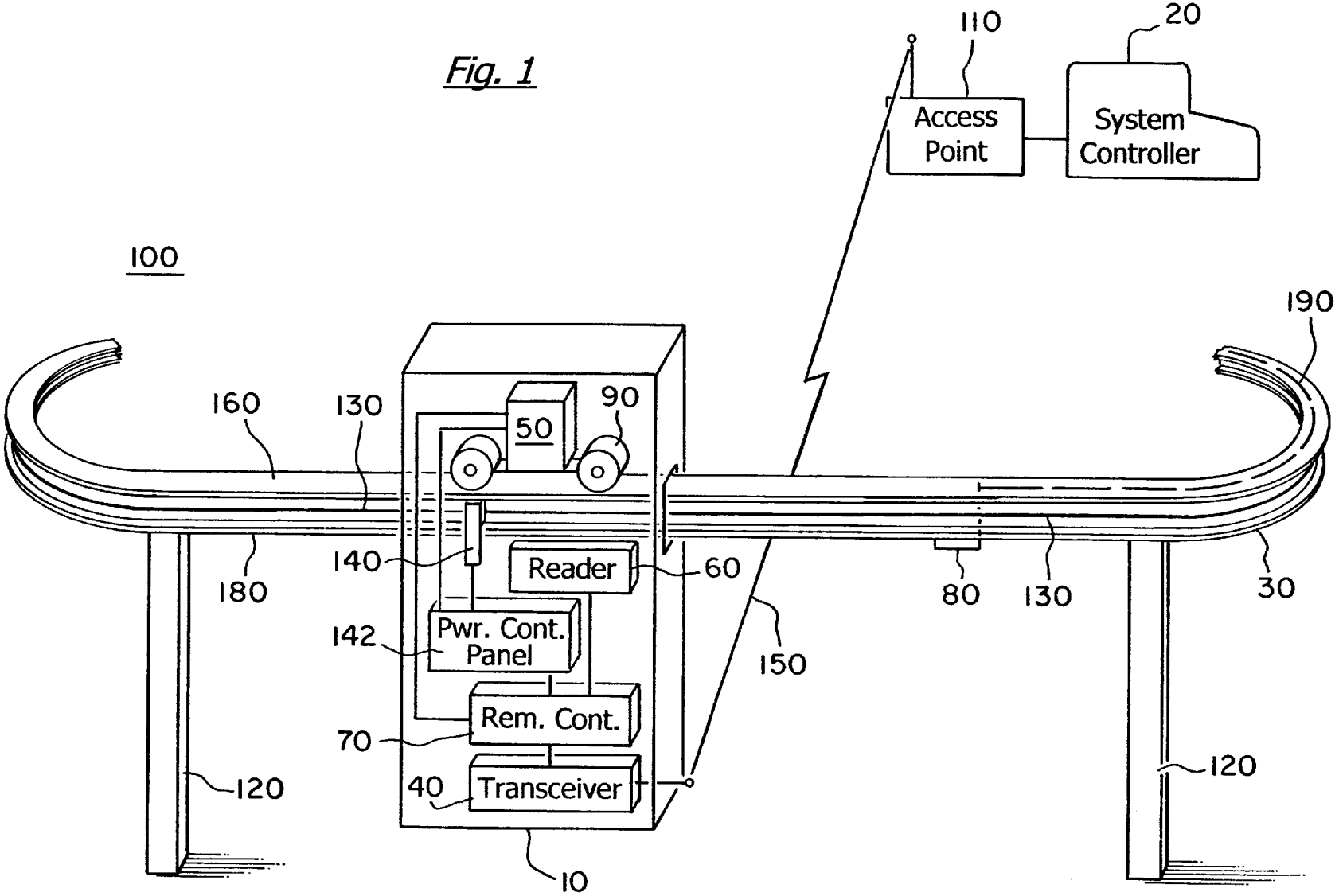
FIG. 1 is a perspective view of one embodiment illustrating the automated electrified monorail system of the present invention.

In one embodiment, as generally illustrated in FIG. 1, the automated electrified monorail (AEM) system 100, generally, contains a monorail 30, a vehicle 10 and a system controller 20. Only a portion of the monorail 30 is shown. A feature of the present invention is that the movement of a vehicle 10 is controlled through a wireless radio-frequency (RF) ethernet network which contains the system controller 20 and the remote controller 70. It should be appreciated that any number of vehicles 10 may be positioned to move on the monorail 30 during normal operation. The use of a wireless RF ethernet network permits high speed data communication between the vehicle 10 and the system controller 20. The wireless RF ethernet network 150 also allows program changes in the remote controller 70 to occur at anytime during operation of the AEM system 100.

Figure 7:
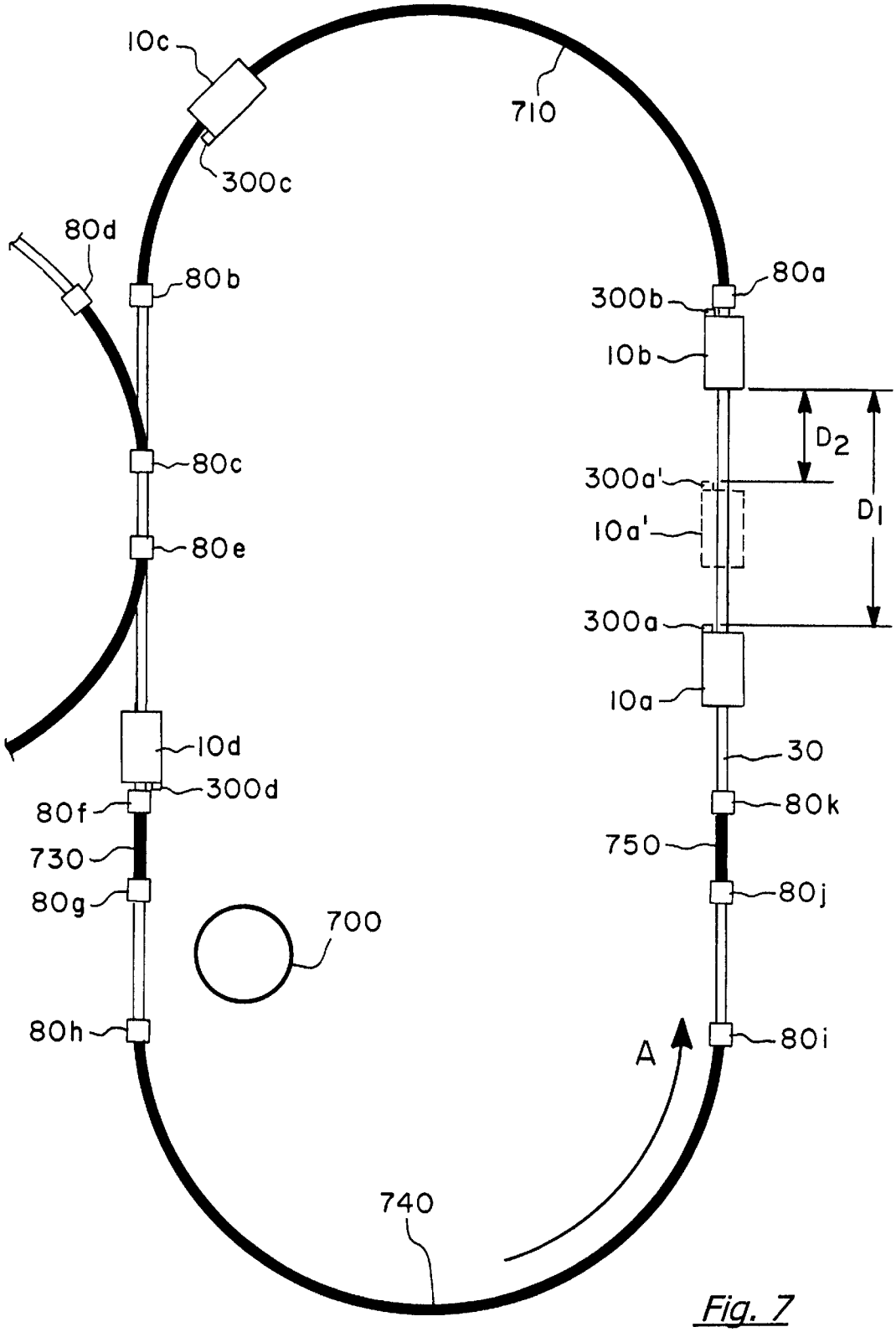
FIG. 7 is a top view of the automated electrified monorail system illustrating collision avoidance, obstacle avoidance, movement zones and other features of the present invention.

Another feature of the present invention is that location markers 80 are used to define movement zones 190 in FIG. 1 and 710–750 shown in FIG. 7 along the monorail 30. The location markers 80 are attached to the monorail 30 and are easily moved to modify or change the location of the movement zones.

Figure 2:
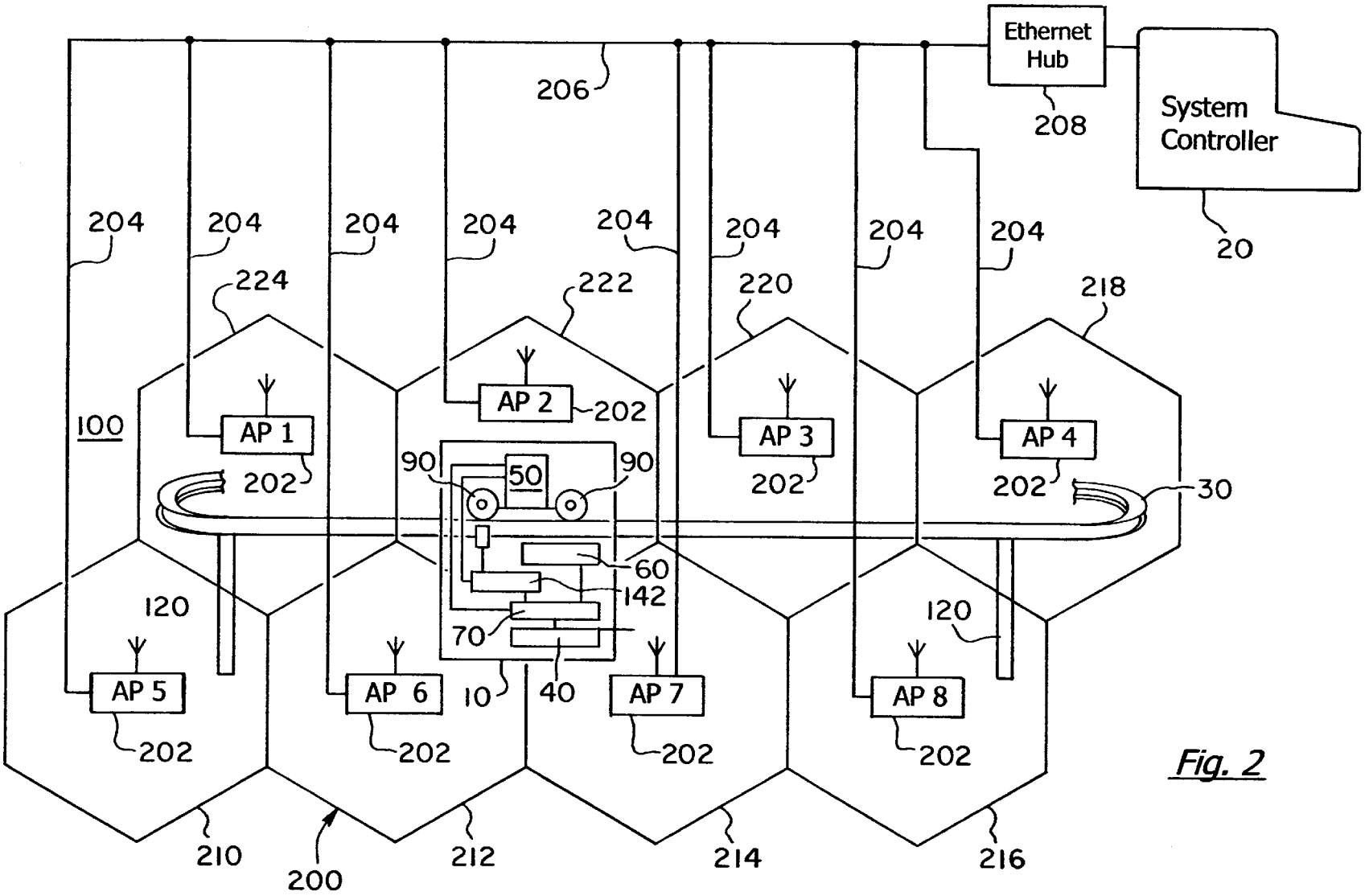
FIG. 2 is a perspective view of another embodiment of the automated electrified monorail system of the present invention.

In another embodiment, as shown in FIG. 2, the AEM system 100 contains a cellular network 200 that comprises a number of cells 210, 212, 214, 216, 218, 220, 222 and 224. Each cell contains an access point 202 that is connected to an ethernet backbone 206 through lines 204. The ethernet backbone 206 is connected to an ethernet hub 208 that is connected to the system controller 20. The cells are set out to completely cover the vehicle 10 no matter where it is traveling on the monorail 30 such that the vehicle 10 will always be in radio contact with at least one of the access points 202. It should be noted that the cells set out in FIG. 2 are drawn for illustration and that the cell coverage boundaries need not be hexagonally shaped, can overlap and/or a single cell can cover the entire AEM system 100.

The transmission protocol between the remote controller 70 and the access points 202 is typically an industry standard protocol, e.g., IEEE 802.11 wireless transmission standard.

In summary, the AEM system 100 of the present invention does not require the use of a number of costly bus-bar-type control conductors that are physically installed along the perimeter of the monorail 30 that provide limited bandwidth between the vehicle 10 and the system controller 20. Rather the system controller 20 is remotely located at any suitable location and delivers high speed data at greater bandwidth to the vehicle 10 through the air so that not only is the high cost of the conventional bus-bar-type control conductors avoided but greater speed and greater bandwidth is obtained. In addition, the present invention can be installed in locations where conventional AEM systems could not be installed due to spatial constraints. The AEM system 100 is not limited to the physical layout of the monorail 30 nor to the environment the monorail 30 is located in. Furthermore, while one vehicle 10 is illustrated in FIG. 1, it is to be expressly understood that many different conventionally available vehicles can be modified to conform to the teachings contained herein.

2. The Automated Electrified Monorail (AEM) System 100 of the Present Invention In FIG. 1, one embodiment of the automated electrified monorail (AEM) system 100 contains a monorail 30, a vehicle 10 and a system controller 20. In the embodiment shown, the monorail 30 is mounted in an overhead configuration on beams 120. However, the monorail 30 could be mounted in a top, side, interior, exterior or underneath configuration with respect to the beams 120. In a preferred embodiment, the monorail 30 is an industry standard aluminum rail having an I-type cross-sectional profile. At the largest dimension, the I-type beam may have a cross section of 180 millimeters by 60 millimeters or a cross section of 240 millimeters by 80 millimeters. This dimension allows the monorail to nominally support up to 1200 kilograms. However, additional structural support may be added to the AEM system 100 to increase the weight limits of the monorail 30. It should be appreciated that the monorail 30 may be any suitable geometric cross-section, and of sufficient structure or material that is capable of supporting the vehicle 10 as herein described.

The vehicle 10 contains a drive motor 50 that is attached to wheels 90 which propel the vehicle 10 along the monorail 30. In a preferred embodiment, the motor 50 is attached to one wheel 90 to drive the vehicle 10 on the monorail. In addition to the wheels 90, guide wheels 810 (FIG. 8) may be positioned on the vehicle 10 so that the guide wheels 810 assist in contacting the sides 820 of the monorail 30, especially, during movement along curved portions of the monorail 30. Generally, the vehicle 10 contains an electrical connector 140 that engages power conductors 130 as the vehicle 10 moves along the monorail 30. The electrical connector 140 is connected to a power control panel 142 that, typically, contains electrical disconnect electronics, fuses and a transformer. The power control panel 142, then, supplies power to the motor 50 and the remote controller 70.

A reader 60 is also contained in the vehicle 10 for reading location markers 80 to determine the location of movement zones 190 in FIG. 1 and 710–750 in FIG. 7 as will be explained later.

Figure 4:
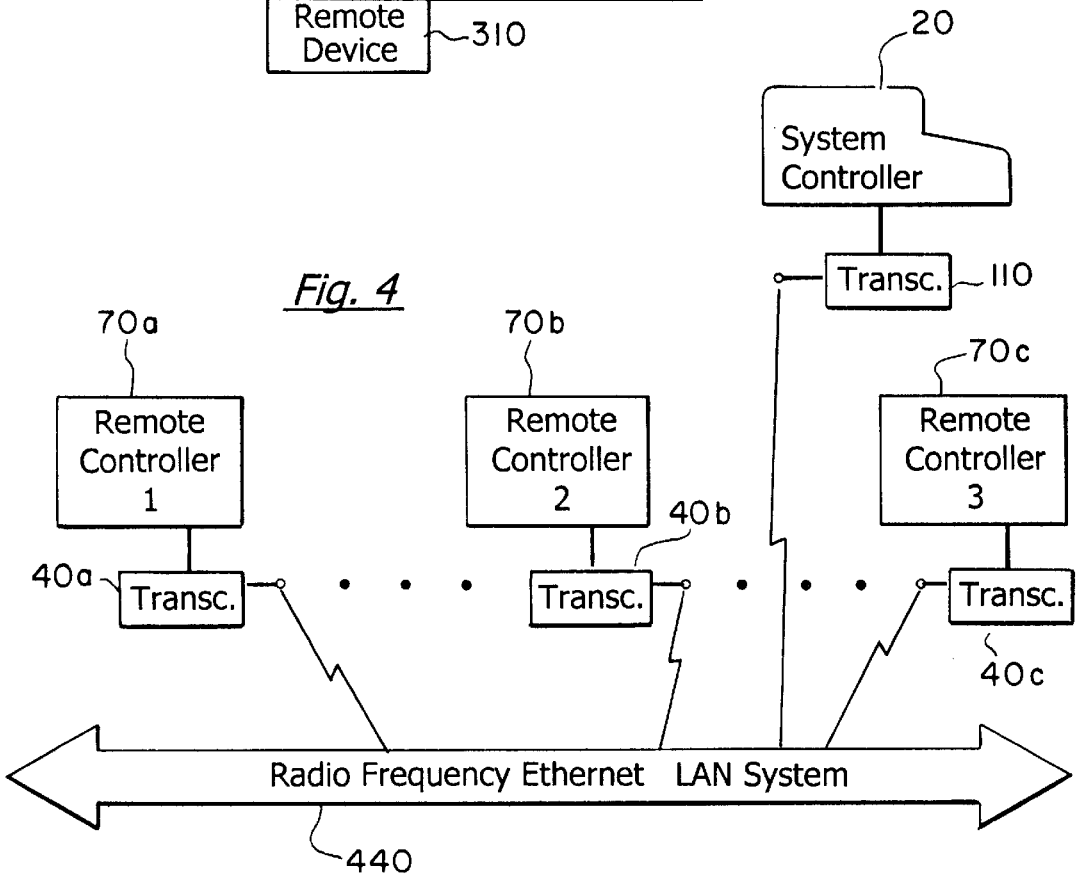
FIG. 4 is a block diagram of the radio-frequency ethernet local access network in the automated electrified monorail system of the present invention.

A remote controller 70 is contained in the vehicle 10 and is connected to the motor 50, the reader 60 and a remote RF ethernet transceiver 40. In a preferred embodiment, the remote controller 70 is an ethernet-capable controller. The remote controller 70, through the remote RF ethernet transceiver 40, is wirelessly connected to the system controller 20 through an ethernet access point 110. Therefore, as shown in FIG. 4, a wireless ethernet local access network (LAN) system 440 (also called a wireless RF ethernet network) is created containing the system controller 20 and the remote controller 70*a*, 70*b* and 70*c*. Also shown in FIG. 4, more than one remote controller 70*a*, 70*b* and 70*c*, and hence more than one vehicle 10 can be positioned on the monorail 30. As such, each remote controller 70*a*, 70*b* and 70*c* having remote RF ethernet transceivers 40*a*, 40*b* and 40*c* can be connected to the system controller 20 through the ethernet access point 110 and, thus, the wireless ethernet LAN system 440 can contain the system controller 20 connected to a plurality of remote controllers 70*a*, 70*b* and 70*c*.

The AEM system 100 of the present invention is conventionally electrified by power lines 130 having, typically, three phase 480 volts AC power lines and a ground wire. The power lines 130 are conventionally hardwired along the perimeter of the monorail 30 and may be commercially purchased (e.g., Vahle U10 bus bar). It should be noted that any type of power line carrying any suitable voltage may be used. However, in a preferred embodiment, the power line 130 provides intrinsic safety precautions and meets all UL/CSA safety standards.

Power is provided to the vehicle 10 from the power line 130 through contact 140 that is a commercially available sliding contact brush (compatible with the Vahle U10 bus bar). However any other contact having similar quality can be used. In addition to the fuses located in the power control panel 142, the contact 140 can be fused for overvoltage protection.

In summary, the present invention is not limited to a specific monorail design, to one type of vehicle configuration or to how power is delivered to the vehicle 10 and the components contained therein.

a. Motors and Remote Devices

In a preferred embodiment, as shown in FIG. 8, the vehicle 10 contains a drive motor 50 that is connected to one wheel 90 to move the vehicle 10 on the monorail 30. In another embodiment, the vehicle 50 may contain three motors. A hoist motor is provided to lower a fixture from the vehicle 10 on the monorail 30. A drive motor is also provided to move the vehicle 10 along the monorail 30. Additionally, a rotation motor is provided to rotate a fixture mounted on the vehicle 10 about the monorail 30. In a preferred embodiment, the motors are typically commercially available electric motors (e.g., Allen-Bradley 160 SCC variable frequency drives and Bauer electric motors) requiring 120 to 480 volts AC, 0.5 to 1 horsepower and 0.37 to 0.75 kW of power. Therefore, a converter can be required to convert the 480 volts AC signal to the appropriate voltage.

The vehicle 10 contains a braking mechanism to assist in stopping the vehicle 10 from moving along the monorail 30. Specifically, the drive motor 50 has a braking mechanism that can be controlled by the remote controller 70 through a relay, not shown. The relays are commercially available (e.g., Allen-Bradley 100-M05). The drive motor 50 has a failsafe feature that engages the braking mechanism whenever power is removed from the driver motor 50.

Figure 3:
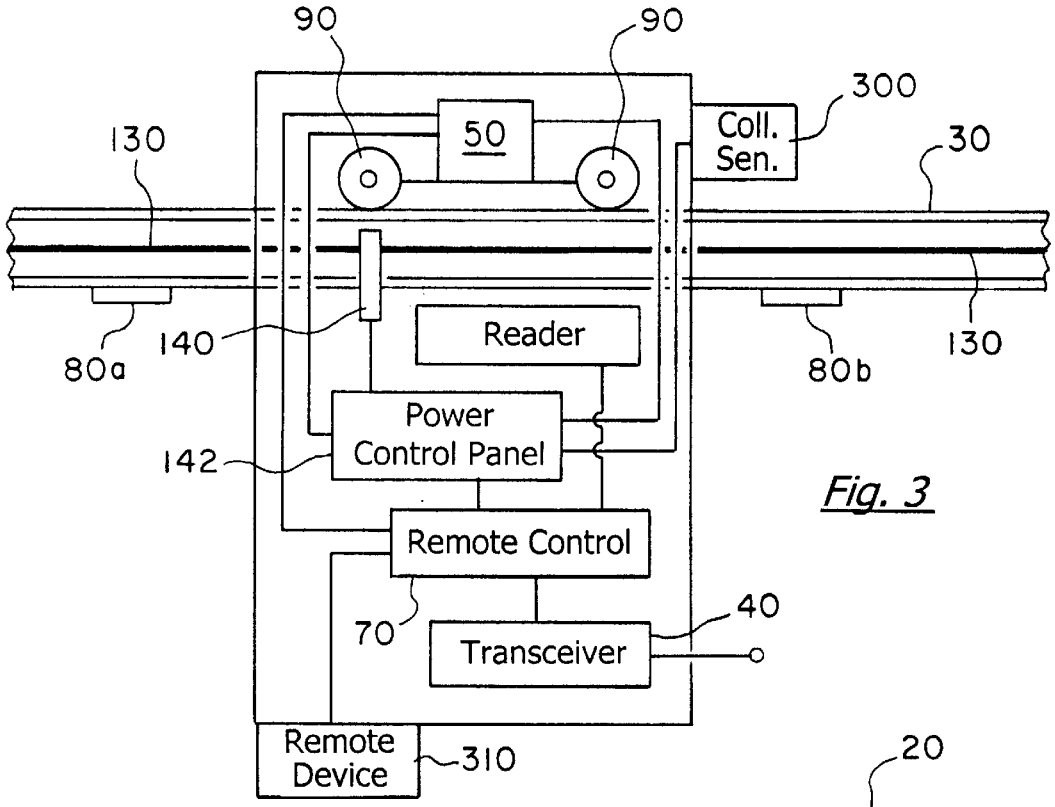
FIG. 3 is a block diagram view of a vehicle in the automated electrified monorail system of the present invention.

As shown in FIG. 3, the vehicle 10 may also contain a remote device 310 (e.g., a motor) to perform tasks. Typically, the tasks are performed at the ground level, and may include lifting or moving objects in a warehouse or moving construction devices (e.g., a welding mechanism or electronic readers for inventory control). In addition, a robotic mechanism may be attached to the vehicle 10 to perform any desired task. However, it should be appreciated that the remote device 310 may perform tasks at any position relative to the vehicle 10. The remote device 310 may perform tasks above, on the side, in front of, in back of, inside of and outside of the vehicle 10 or any similar variation thereof.

In operation, the vehicle 10 has conventional wheels 90 that contact either a top portion 160 (FIG. 1) and/or a bottom portion 180 (FIG. 1) and/or sides 820 (FIG. 8) of the monorail 30. Also shown in FIG. 8, guide wheels 810 may be connected to the vehicle 10. The guide wheels 810 contact the sides 820 of the monorail 30 to assist in movement of the vehicle 10 around the curved portions of the monorail 30. Typically, the motor 50 drives one of the wheels 90 to propel the vehicle 10 along the monorail 30. The speed of the motor 90 and other variables are controlled by the remote controller 70 that receives instructions from the system controller 20. This program control from the system controller 20 to the remote controller 70 may occur at initialization or may occur in real-time during operation of the AEM system 100. The instructions are transmitted over the wireless ethernet LAN system 440 by the remote RF ethernet transceiver 40 and the ethernet access point 110.

In summary, any of a number of different motor, braking and remote devices can be utilized under the teachings of the present invention and the system 100 is not limited to any one design. Furthermore, any suitable remote device for performing any number of desired activities could be utilized under the teachings of the present invention.

b. Controllers and Radio-Frequency Devices

In a preferred embodiment, the system controller 20 contains a commercially available system controlled programmable logic controller (PLC) (e.g., Allen-Bradley 5/40E) that is ethernet-enabled. The system controller 20 is hardwired via an ethernet link to a commercially available mainframe computer (e.g., Hewlett-Packard 9000). The system controller 20 is connected to a commercially available ethernet access point 110 (e.g., Symbol Spectrum 24 Ethernet Access Point).

The vehicle 10 contains a remote controller 70, such as, a commercially available carrier PLC (e.g., Allen-Bradley SLC 5/05) that is ethernet-enabled. The remote controller 70 is hardwired to a commercially available remote RF ethernet transceiver 40 (e.g., Symbol Spectrum 24 Ethernet Bridge). In one embodiment, the remote RF ethernet transceiver 40 and the ethernet access point 110 operate in the 2.4 GHz frequency range with 1–2 Mbps throughput on the wireless connection and 10 Mbps throughput on the hardwired connection. This data throughput is significantly greater throughput than that achieved with the prior bus-bar-type conductors. However, it should be noted that the remote RF ethernet transceiver 40 and ethernet access point 110 may operate at any desired ethernet frequency and the present invention should not be limited to the examples discussed herein. Further, it should be appreciated that, in other embodiments, the ethernet access point 110 may comprise a commercially available ethernet bridge and the remote RF ethernet transceiver 40 may compromise a commercially available ethernet access point and/or any combination thereof.

Typically, information is transferred to and from the system controller 20 and the remote controller 70. The information typically contains PLC programming commands (e.g., Allen-Bradley MSG commands). As shown in FIG. 4, the remote controller 70 is capable of interfacing with the system controller 20 through the wireless ethernet LAN system 440. Since the controllers are ethernet-enabled, the wireless ethernet LAN system 440 between the controllers uses standard ethernet protocol. Therefore, there is no need for protocol converters. The wireless ethernet LAN system 440 identifies each remote controller 70 by a separate and unique vehicle identification address defined by the transmission control protocol/internet protocol (TCP/IP) standards or the media access control (MAC) protocol defined by the MAC layer of the ethernet protocol. Such an identification protocol is standard over the wireless ethernet LAN system 440. The unique vehicle identification address of the vehicle 10 is resident in memory located on the vehicle in the remote controller 70. This memory saved address can be easily changed at any time by the system controller 20. In another embodiment, the unique vehicle identification address can be hardwired on the vehicle, such as using configurable switches. In one embodiment, the remote RF ethernet transceiver 40 and the ethernet access point 110 operate in a base-mobile unit relationship with the system controller 20 being the base and the remote controller 70 being the mobile unit. However, this relationship may be reversed depending upon the requirements of the AEM system 100.

In the embodiment shown in FIG. 2, the cellular network 200 comprises a number of cells 210, 212, 214, 216, 218, 220, 222 and 224. Each cell contains an access point 202 that is connected to the ethernet backbone 206 by lines 204. The ethernet backbone 206 can optionally be connected to an ethernet hub 208 that is connected to the system controller 20. The remote RF ethernet transceiver 40 communicates with one of the strategically placed, access points 202. The cellular network 200 has automatic roaming features that provide continuous real-time communication with the remote RF ethernet transceiver 40. The cellular network 200 is a frequency hopping, spread-spectrum RF wireless ethernet LAN system 440 complying with IEEE 802.11 standard. It should be noted that additional access points 202 can be added to the AEM system 100 to increase the size of the coverage area of the cellular network 200.

It is expressly understood that while the above discussion sets forth two basic preferred embodiments for implementing the invention along with preferred frequency ranges of operation, any suitable implementation design could be constructed under the teachings herein and any suitable RF transmission frequency range or ranges could be used.

c. Location Markers

As shown in FIG. 1, the AEM system 100 contains location markers 80 that allow the system controller 20 to track the location of the vehicles 10 on the monorail 30. The vehicle 10 contains a reader 60 that typically comprises a commercially available (e.g., Micron Communications, Inc.) tuned antenna that operates at 125 MHz. The location marker 80 contains a commercially available (e.g., Micron Communications, Inc.) RF electronic marker that operates at 125 MHz. This frequency range is different from the ethernet range of 2.4 GHz and, therefore, provides separate RF communication.

In operation, the location marker 80 is sensed by the reader 60 as the vehicle 10 is near the location marker 80. As shown in FIGS. 3 and 7, typically, more than one location marker **80*a*–80*k* is contained in the AEM system 100. The location markers 80*a*–80*k* are located in strategic positions along the monorail 30 and are attached on the monorail 30. It should be appreciated that attachment to the monorail 30 contains placement near, on or at the monorail 30. In a preferred embodiment, the location markers 80*a*–80*k* are attached to the monorail 30 using a suitable adhesive that is capable of withstanding the shock and vibrations inherent in the AEM system 100. This attachment allows the location markers 80***a*–80*k* to be physically moved as desired or required by the AEM system 100.

In a preferred embodiment, the location markers 80*a*–80*k* conventionally comprise passive or active radio frequency electronics and the reader 60, comprising a tuned antenna, is capable of sensing the location markers 80*a*–80*k*. In another embodiment, the location markers 80*a*–80*k* comprise a bar code that is attached on the monorail 30 and the reader 60, comprising a bar code reader, is capable of physically reading the location markers 80*a*–80*k* as the vehicle 10 passes by. It should be noted that any suitable pair of devices that provide an identification marker on the monorail and a sensor on the vehicle that is capable of reading the marker may be used in the present invention.

The reader 60, typically, contains a commercially available electronic reader (e.g., Micron Communications, Inc., Model No. MPIPEA2321) and a commercially available antenna (e.g., Micron Communications, Inc., Model No. MPAPE8X22P). In a preferred embodiment, the antenna of the present invention has the dimensions of about 12 centimeters by 36 centimeters and is tuned. The antenna has been optimized for the present invention to allow for quicker read times as the moving vehicle 10 passes the location marker 80 and to add more flexibility for directional reading. The optimal characteristics of the antenna in the reader 60 were found by increasing the length of the antenna. In conventional readers, the antenna has a length of about 11 to 21 centimeters. In the present invention, the reader 60 has an antenna with a length of 36 centimeters. This increase of about 170–320 percent in antenna length allows the reader 60 to sense the location markers 80 as the vehicle 10 moves along the monorail 30.

In a preferred embodiment, as shown in FIGS. 1 and 3, the reader 60 of the present invention is typically located on the vehicle 10 to face the bottom portion 180 of the monorail 30. In this position, the location markers 80, which are attached to the bottom portion 180 of monorail 30, pass directly above the reader 60. However, it should be appreciated that the reader 60 may face the top 160 or side 820 portions of the monorail 30 or may be placed in any other configuration that allows the reader 60 to sense and read the location marker 80.

As shown in FIGS. 3 and 7, when the vehicle 10 travels along the monorail 30, each one of the location markers 80*a*–80*k* is sensed by the reader 60. The location markers 80*a*–80*k* provide location information, such as a string of characters or numbers.

In one embodiment, the location markers 80*a*–80*k* and the reader 60 have been optimized to decrease time delays associated with sensing location information contained in the location markers 80*a*–80*k*. In this regard, the location markers 80*a*–80*k* typically contain an ASCII string that converts to a number because numbers decrease the time delay associated with processing the information in the remote controller 70.

The reader 60 supplies the location information to the remote controller 70 where the location information is then compared to a program list of commands that is supplied to the remote controller 70 from the system controller 20 and which is stored in memory in the remote controller 70. In a preferred embodiment, the program list uses the Allen-Bradley PLC programming language. The program list may contain several programmed tasks. For example, a "slow-down" command sensed from a location marker 80 is used by the remote controller 70 to command the vehicle 10 to reduce its traveling speed, such as, to reduce the current speed to "creep-speed". A "transmission" command is used to command the vehicle 10 to transmit information to the system controller 20. A "permission" command is used to command the vehicle 10 to query the system controller 20 for permission to enter a movement area, such as a curve area. A "stop" command is used to command the vehicle 10 to stop at a specified location. A "stop-at-next-tag" command is used to command the vehicle 10 to stop when the next location marker 80 is sensed. A "perform-task" command is used to command the vehicle 10 to perform a predetermined task at a specified location. When the remote controller 70 matches the location information received from a location marker 80 to the stored program list, the command associated with the location marker 80 is performed. If the location information is not on the programmed list then the remote controller 70 transmits an error message to the system controller 20. While the commands set forth above are used in the preferred embodiment, any suitable command (and corresponding "name" for the command) can be used under the teachings of the present invention.

As shown in FIG. 9, the data sequence 940 that is transmitted to and from the system controller 20 and the remote controller 70 has a format containing packets 900, 910, 920 and 930. In one embodiment, the entire data sequence 940 has a length of 50 characters. Data packet 900 contains the unique vehicle identification address according to the TCP/IP standard. This transmission of the unique vehicle identification address is redundant because the wireless ethernet LAN system 440 used the vehicle identification address to establish RF communication between ethernet transceiver 60 and ethernet access point 110. However, the unique vehicle identification address is included in data packet 900 as a double-checking safety consideration. The second packet 910 contains a message sequence number that is used to identify the messages that have been sent between the system controller 20 and the remote controller 70. The next packet 920 contains the current location marker 80 information that was sensed by the reader 60 on the vehicle 10. The final data packet 930 contains "current location status" or "performance" commands. The "current location status" command is a request for the status at current location of the vehicle 10, and the "performance" command is a command for the vehicle 10 to perform a function or task.

It should be appreciated that, under the teaching of the present invention, additional data packets can be added to the data sequence 940 such that the length of the data sequence is larger or smaller than 50 characters. Also the data packets 900, 910, 920 and 930 may be combined or divided into a smaller number of data packets. Further, the embodiment shown in FIG. 9 is used for illustration and should not be construed to limit the present invention to the embodiment explained herein.

As shown in FIG. 7, the location markers 80*a*–80*k* delineate specific movement zones 710–750 on the monorail 30 where the vehicles 10*a*–10*d* must perform some type of activity (e.g., change speeds or switching from one AEM system to another); also shown in FIG. 7 are stations 750 ("slow-down" areas or "actual destination"); curve portions 710 and 740 (speed change and collision avoidance); switch entry and exit areas 720 (speed change and switch positioning).

As shown in FIG. 7, movement zone 750 represents a station. The vehicles 10*a*–10*d* are typically stopped at the station 750. To perform this stopping, a paired marker scheme (80*j* and 80*k*) is used. The location markers 80*j* and 80*k* are attached on the monorail 30 and are sensed by the vehicles 10*a*–10*d*. The vehicles 10*a*–10*d* travel around the monorail 30 in the direction of arrow A. When location marker 80*j* is sensed, the vehicles 10*a*–10*d* slow down (e.g., from "medium speed" to "creep-speed"), and when location marker 80*k* is sensed the vehicles 10*a*–10*d* stop. The location markers 80*j* and 80*k*, as earlier discussed, provide the command information to the remote controller 70 in the vehicles 10*a*–10*d*.

In FIG. 8, proximity sensors 830 that sense proximity markers 840, positioned on or near the monorail 30, may also be used to position the vehicle 10 on the monorail 30. The proximity sensors 830 are attached to the vehicle 10 and connected to the remote controller 70. The proximity sensors 830 are used to accurately control the movement of the vehicle 10 on the monorail 30. The proximity marker 840 is aligned with the proximity sensor 830 such that a signal may be emitted from the proximity sensor 830 and reflected off the proximity marker 840 back to the proximity sensor 830. For example, the vehicle 10 may sense location marker 80 which corresponds to a command on the program list in memory on the remote controller 70 to reduce its speed and to monitor for the proximity sensors 830. Once the proximity sensor 830 on vehicle 10 senses the proximity marker 840 the vehicle 10 will stop. The proximity sensors 830 allow the vehicle 10 to be positioned on the monorail 30 within an accuracy of about 2 millimeters. In one embodiment, the proximity sensors 830 comprise infrared or photo sensors, and the proximity markers 840 comprise reflective-type or non-reflective-type materials that are secured to the monorail 30 by any suitable attachment mechanisms (e.g., adhesives, clamps, screws or bolts). However, it should be appreciated that any suitable pair of alignment detection devices may be utilized to control the precision movements of the vehicle 10.

As shown in FIG. 7, movement zones 710 and 740 represent curve areas. When one of the vehicles 10*a*–10*d* enters the curve areas 710 and 740, a paired marker scheme (80*a*–80*b* and 80*h*–80*i*) is also used. Specifically referring to movement zone 710, vehicle 10*b* senses the location marker 80*a* which provides a command to the remote controller 70 which in turn transmits to the system controller 20 and query whether another vehicle, such as vehicle 10*c*, is in the curve area 710. If the system controller 20 responds that vehicle 10*c* is in curve area 710, vehicle 10*b* is instructed to enter creep speed. If vehicle 10*c* is not in the curve area 710 or the system controller 20 notifies vehicle 10*b* that the curve area 710 is unoccupied, vehicle 10*b* enters the curve area 710 at a predetermined speed. If, as shown in FIG. 7, vehicle 10*c* is located in curve area 710, vehicle 10*c* will notify the system controller 20 when vehicle 10*c* passes location marker 80*b*. When vehicle 10*c* has passed identification marker 80*b*, the system controller 20 will instruct vehicle 10*b* to enter the curve area 710. Using this technique, the system controller 20 makes the determination that vehicle 10*b* is in the curve area 710 and the system controller 20 will not allow another vehicle 10*a*, 10*c* or 10*d* into the curve area 710 until vehicle 10*b* exits the curve area 710.

It is to be appreciated that FIG. 7 illustrates several functional features found in the use of the location markers 80*a*–80*k* of the present invention. The location markers 80*a*–80*k* can be easily moved and/or their command content changed, in stark contrast to the prior AEM systems requiring physical cutting of the bus-bar-type conductors. For example, if it is decided to add or remove a stop on the monorail 30, it can be easily accomplished under the teachings of the present invention by simply adding or removing location markers 80*a*–80*k* and/or proximity sensors 830 and proximity markers 840. The embodiment shown in FIG. 7 is shown to illustrate the use of such location markers 80*a*–80*k* and that the location markers 80*a*–80*k* can be used to implement any of a number of equivalent features including, but not limited to: stopping, slowing down, speeding-up, turning, entering, exiting, transmitting, querying and performing tasks.

Figure 5:
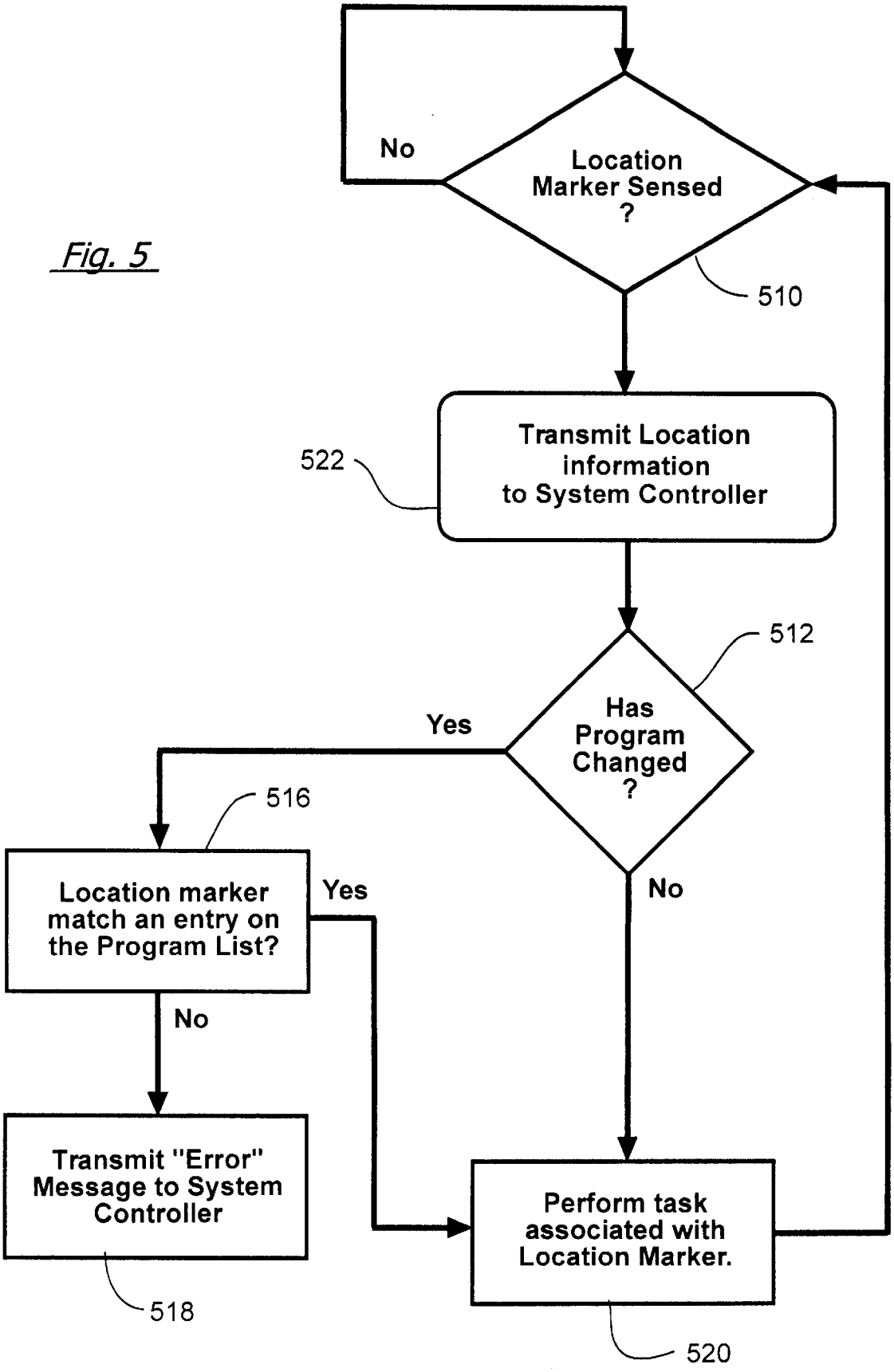
FIG. 5 is a functional flow chart representation of a location marker sensing method used by a vehicle of the present invention.

As shown in FIG. 5, a method is shown that illustrates the functional steps to be performed when a location marker 80 is sensed. In step 510, the remote controller 70 determines by monitoring the output from the reader 60 whether one of the location markers 80*a*–80*k* has been sensed. If one of the location markers 80*a*–80*k* has not been sensed, the remote controller 70 keeps monitoring the output of the reader 60. If one of the location markers 80*a*–80*k* has been sensed, the location information is transmitted to the system controller 20 in step 522 and in step 512, the remote controller 70 determines whether a program change has been made. It should be noted that in step 522 the location information is sent to the system controller 20 when it is sensed by one of the vehicles 10*a*–10*d*. This location information allows the system controller 70 to approximately know where the vehicle 10 is located on the monorail 30, such as during a curve entry or exit. If a program change has not been initiated then the associated task is automatically performed in automatic mode 520.

Automatic mode is a programmed state where the vehicles 10*a*–10*d* proceed along the monorail 30 and perform tasks as instructed by the commands on the program list located in memory on the remote controller 70 corresponding to the location markers 80*a*–80*k*. Before, the vehicles 10*a*–10*d* can travel in automatic mode, the vehicles 10*a*–10*d* must receive a program list from the system controller 20 and the vehicles 10*a*–10*d* must sense one of the location marker 80*a*–80*k*. Typically, upon initialization or upon a program change, the vehicles 10*a*–10*d* will move at "creep-speed" until one of the location markers 80*a*–80*k* has been sensed. Once one of the location markers 80*a*–80*k* has been sensed, one of the vehicles 10*a*–10*d* will continue along the monorail 30 according to the programmed instruction set in the remote controller 70.

Typically, when the system controller 20 changes the program list located in memory on the remote controller 70, a program change will continue to be indicated by the remote controller 70 until one of the vehicles 10*a*–10*d* has verified its location on the monorail 30, typically, by sensing one of location markers 80*a*–80*k*. Once this procedure has been followed, the vehicles 10*a*–10*d* proceed along the monorail 30 and perform tasks as instructed by the commands on the program list located in memory on the remote controller 70 corresponding to the location markers 80*a*–80*k*. It should be noted that the program in the vehicles 10*a*–10*d* can be changed at anytime without stopping the vehicles 10*a*–10*d* on the monorail 30 or without shutting down the AEM system 100, in general. This automatic procedure is used for safety considerations to make sure the program list is correct.

Referring back to step 512 in FIG. 5, if a program change has been initiated, the vehicles 10*a*–10*d* do not enter automatic mode. Instead the remote controller 70 checks the location marker 80*a*–80*k* information with the program list in step 516. If the location information is on the program list, the task associated with the location information is performed in step 520. However if the location information is not on the program list an error message is optionally transmitted to the system controller 20 from the remote controller 70 in step 518.

d. Collision Avoidance System

Figure 10A:
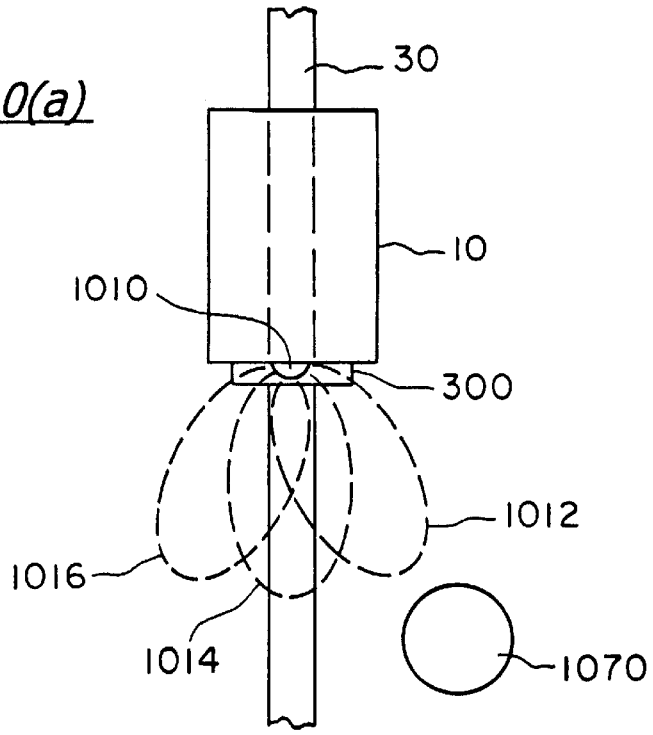
FIG. 10*a* illustrates a top view of the collision avoidance system of the present invention having a multiple detection lobe sensor.

As shown in FIG. 3, the vehicles contain a collision avoidance device 300 that is also connected to the remote controller 70. The collision avoidance device 300 typically contains commercially available photo-sensors or infrared-sensors (e.g., SUNX PX-22 photo sensors) that are attached to the front of the vehicle 10 so as to have a clear view of the monorail 30 in front of the vehicle 10. In a preferred embodiment, the collision avoidance device 300 should have at least a three meter range and provides adjustable multiple lobe sensing areas, as shown in FIG. 10*a*. In addition, as shown in FIG. 7, each of the collision avoidance devices 300*a*–300*d* should be capable of sensing a other vehicles 10*a*–10*d* that is at a $D_1$ of three meters, within a 90 degree radius of the vehicle 10*a*–10*d*. It should be noted that, in another embodiment, the collision avoidance device 300 has a detection range of at least 5 meters.

Figure 10B:
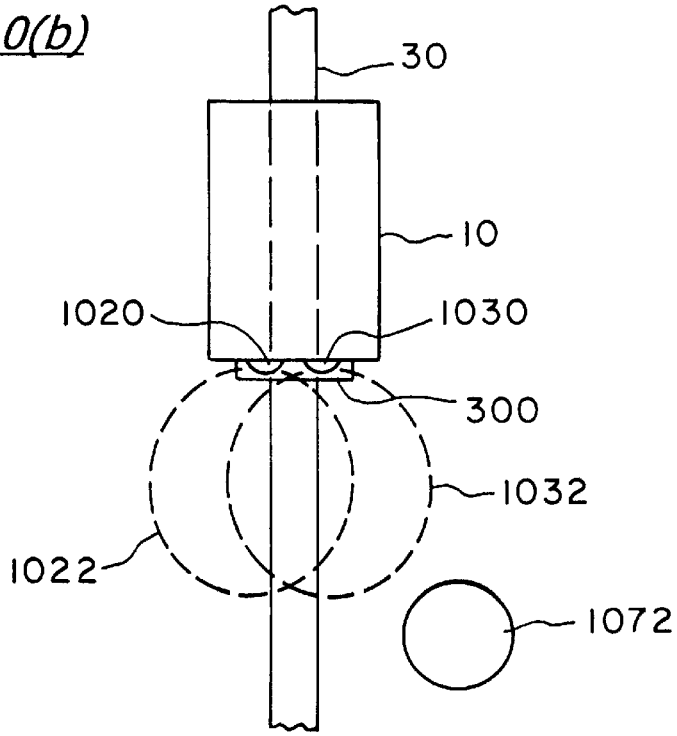
FIG. 10*b* illustrates a top view of the collision avoidance system of the present invention having multiple sensors.

In FIGS. 10*a* and 10*b*, two embodiments of the collision avoidance system 300 are illustrated. In FIG. 10*a*, the collision avoidance system 300 contains a single sensor 1010 that has multiple detection lobes 1012, 1014 and 1016. Each lobe 1012, 1014 and 1016 have an adjustable range. In another embodiment, as shown in FIG. 10*b*, the collision avoidance system 300 contains multiple sensors 1020 and 1030. The sensors 1020 and 1030 have detection lobes 1022 and 1032, respectively that have adjustable ranges. The embodiments shown in FIGS. 10*a* and 10*b* can be interchanged such that the multiple sensor configuration includes sensors that have multiple detection zones. Furthermore, the single sensor configuration may contain a sensor that has a single detection lobe. Furthermore, the single lobe and multiple lobe sensors can also be combined on one vehicle. It should be appreciated that the present invention expressly encompasses other sensor combinations or configurations that can be employed.

It should be noted that in the embodiments, shown in FIGS. 3, 7, 10*a* and 10*b*, each of the collision avoidance devices 300 and 300*a*–300*d* are shown to be attached to the front of the vehicles 10 and 10*a*–10*d*. However, the present invention should encompass any other obvious positioning of the collision avoidance devices 300 and 300*a*–300*d* (e.g., on the rear portion, top portion, side portion or bottom portion of the vehicles 10 and 10*a*–10*d*, and located either above or below the monorail 30).

Figure 6:
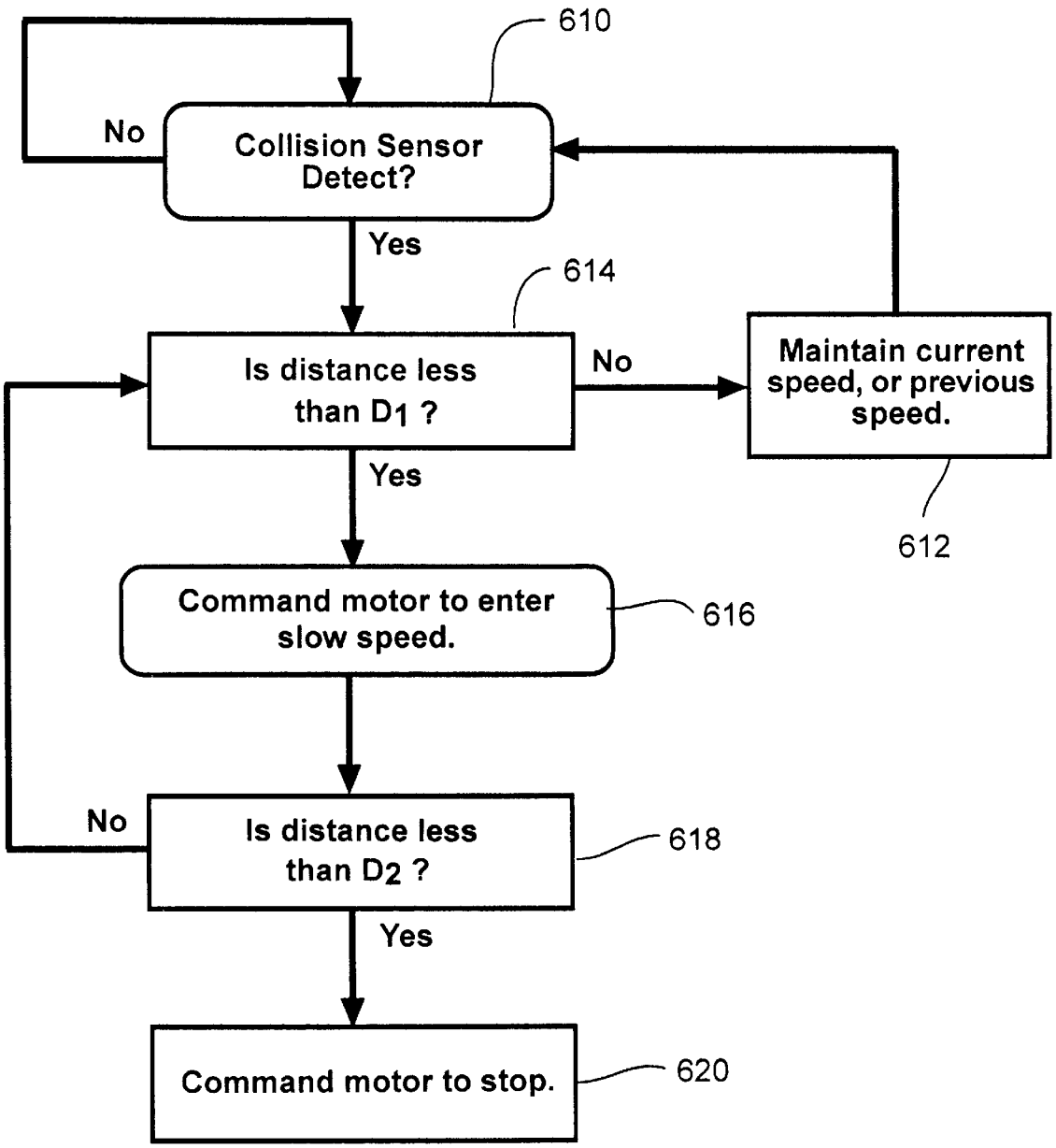
FIG. 6 is a functional flow chart representation of a collision avoidance method used by a vehicle of the present invention.

In operation, as shown in FIGS. 6 and 7 in movement zone 730, the collision avoidance system 300*a* operates to prevent a collision between the vehicle 10*a* and another object, such as another vehicle 10*b* located on the monorail 30. The collision avoidance device 300*a* is capable of sensing the presence of vehicle 10*b* and its projected distance from the vehicle 10*a*.

In the method of FIG. 6 and as illustrated in FIG. 7, the first step 610 determines whether the sensors on the collision avoidance device 300*a* have detected vehicle 10*b*. If the vehicle 10*b* has been detected, the collision avoidance device 300*a* determines whether vehicle 10*b* is located at a distance of less than $D_1$ in step 614. In a preferred embodiment $D_1$ is three meters. If the vehicle 10*b* is at a distance greater than $D_1$, then in step 612, the current speed of the vehicle 10*a* is maintained and collision avoidance device 300*a* continues to monitor for vehicle 10*b*. If vehicle 10*b* is at a distance of $D_1$ or less, vehicle 10*a* is commanded to enter "slow speed" in step 616. As shown in FIG. 7, after vehicle 10*a* senses that vehicle 10*b* is at a distance less than $D_1$, vehicle 10*a* will keep moving along the monorail 30 to be positioned at the location of vehicle 10*a*'. In step 618, a second determination is made as to whether the distance is less than $D_2$. In a preferred embodiment, distance $D_2$ is one meter. If the distance is not less than $D_2$, the distance is checked again in step 614. In step 612, if the distance is greater than $D_1$, the vehicle 10*a* is commanded to resume the previous speed (the speed before the vehicle 10*a* entered "slow speed"). However, in step 618, if vehicle 10*b* is at a distance of less than $D_2$, vehicle 10*c* is commanded to stop in step 620. In one embodiment, the sensing of the vehicle 10*b* may optionally be transmitted to the system controller 20 in an "object sensed" command.

Therefore, the collision avoidance device 300*a* will avoid a collision with vehicle 10*b* by stopping vehicle 10*a* if the vehicle 10*b* is at a distance of less than $D_2$. It should be appreciated that the preferred distances of one and three meters are examples in the embodiment presented. These distances may be changed as the requirements of the system changes. Thus, the present invention should not be construed to be limited to any such distance. Further, it should be appreciated that the collision avoidance device 300*a* is also capable of changing the detection range $D_1$ and $D_2$ as the speed of the vehicle 10*a* increases or decreases. This change in detection distance may be programmed in the remote controller 70. For example, if the vehicle 10*a* is traveling at a speed of 30 meters/minute, the detection distances $D_1$ and $D_2$ are to be set at distances of 800 millimeters and 200 millimeters, respectively. Whereas if the vehicle 10*a* was traveling at a speed of 100 meters/minute, the detection distances $D_1$ and $D_2$ are to be set at distances of 2400 millimeters and 500 millimeters, respectively. The distances and speed relate to the ability of the vehicle 10 to stop upon the detection of an object.

As shown in FIG. 7, vehicle 10*d* may be programmed to ignore an obstacle 700 that is sensed by the collision avoidance device 300*d*. This avoidance is accomplished by placing location marker 80*f* on the monorail 30 where the obstacle 700 is most likely to be sensed by the collision avoidance device 300*d*. The program list contains an ignore object detection command when the location marker information on the location marker 80*f* is compared to the program list. Therefore, when the location marker 80*f* is first sensed by vehicle 10*d*, the controller 70 ignores detection of the object 700. Additionally, location marker 80*g* is placed after the obstacle 700 to instruct the vehicle 10*d* to begin to monitor the collision avoidance device 300*d*. In some designs of the present invention, the use of the second location marker 80*a* is optional. For example, a programmed time-out feature may be used to instruct the vehicle 10*d* to begin to monitor the collision avoidance device 300*d*.

Additionally, as shown in FIGS. 10*a*, portions detection lobes 1012, 1014 and 1016 of the sensor 1010 may be selectively disabled without disabling the entire collision avoidance device 300. For example, detection lobe 1012 may be disabled as the vehicle 10 passes object 1070. However, while detection lobe 1012 is disabled detection lobes 1014 and 1016 are still activated to prevent a collision with other objects or vehicles. In FIG. 10*b*, the sensors 1020 and 1030 may be individually disabled without disabling the entire collision avoidance system 300. In this embodiment, the sensor 1030 may be disabled as the vehicle 10 passes object 1072. While sensor 1030 is disabled, sensor 1020 is still activated to avoid a collision with a vehicle or other object.

3. Method of Operation

The present invention provides a novel method for controlling a vehicle 10 as it moves and performs tasks along the monorail 30. The method includes assigning a unique vehicle identification address to the vehicle located on the monorail 30. The system controller 20 selectively transmits operation instructions to the vehicle 10 using the wireless RF ethernet network 150. The operation instructions comprise a program list of commands or a single command. The transmitted operation instruction contains the unique vehicle identification address. The vehicle 10, having the assigned unique vehicle identification address, receives the selectively transmitted operation instructions. The transmitted operation instructions are stored in memory on the vehicle 10 that has been assigned the unique vehicle identification address.

The stored instructions are then performed by the vehicle 10. In a preferred embodiment, the performance of the stored instruction includes sensing a location marker 80 that is attached to the monorail 30 as the vehicle 10 moves. The location marker 80 contains location information in the form of a unique location string which is compared to the stored program in the remote controller 70 in the vehicle 10. The stored program contains an instruction set having a number of instructions, and each instruction has a unique identifier. A specific instruction from the number of instructions in the instruction set is then executed. The specific executed instruction has a unique identifier that is correlated to the unique location string. The instructions typically include, but are not limited to, stopping the vehicle 10, slowing down the vehicle 10, speeding up the vehicle 10, turning the vehicle 10, entering a movement zone 190, exiting a movement zone 190, transmitting to the system controller 20, querying the system controller 20 and performing tasks. A confirmation command is transmitted from the vehicle 10 that has the unique vehicle identification address to the system controller 20 over said wireless RF ethernet network 150. The confirmation command contains the unique vehicle identification address, among other identifier information, to identify the vehicle 10 that should receive the data. It should be noted that the system controller 20 may transmit a new program list of commands to the remote controller 70 of vehicle 10. It should also be noted that the transmission of the new program list may occur in any vehicle 10 on the monorail 30 and at any time during operation without having to shut down the system 100.

The present invention also includes a novel method for precisely positioning the vehicle 10 on the monorail 30. The method includes the steps of sensing a location marker 80 which includes location information that correlates to commands on the stored program list of commands. The correlated commands include a command for the remote controller 70 to begin to monitor the proximity sensor 830 and a command for the motor 50 to move the vehicle 10 at a predetermined slow speed. The vehicle 10 continues along the monorail 30 at the predetermined slow speed until the proximity sensor 830 senses the proximity marker 840. When the proximity marker 840 is sensed, the vehicle 10 is commanded to stop.

The method also includes the steps of identifying an obstacle 700 in the movement path of the vehicle 10, and avoiding a collision with the obstacle 700. In avoiding the obstacle 700, the obstacle 700 is sensed by the vehicle 10 within at least about three meters of the vehicle 10. After sensing the obstacle 700, the vehicle 10 is instructed to move at a first predetermined low velocity. If the obstacle 700 is sensed to be within at least about one meter of the vehicle 10, the vehicle 10 is instructed to stop moving.

In a second aspect of the p resent method, the vehicle 10 may be instructed to ignore the obstacle 700. In this method, the vehicle 10 senses a location marker 80 which is correlated to an instruction that commands the remote controller 70 in the vehicle 10 to ignore the detection of the object 700. Once the vehicle 10 has passed the object 700, the remote controller 70 of the vehicle 10 may be instructed to again begin to detect object 700. This instruction to begin sensing may be accomplished by placing another location marker 80 on the monorail 30 that correlates to an instruction to again avoid other obstacles 700. In another embodiment, the remote controller 70 of the vehicle 10 may include a programmed timer that instructs the remote controller 70 to again begin to avoid object 700 after a specified predetermined time has elapsed.

The foregoing discussion of the invention has been presented for purposes of illustration and description. Further, the description is not intended to limit the invention to the form disclosed herein. Consequently, variation and modification commensurate with the above teachings, within the skill and knowledge of the relevant art, are within the scope of the present invention. The embodiment described herein and above is further intended to explain the best mode presently known of practicing the invention and to enable others skilled in the art to utilize the invention as such, or in other embodiments, and with the various modifications required by their particular application or uses of the invention. It is intended that the appended claims be construed to include alternative embodiments to the extent permitted by the prior art.

What is claimed is:

1. A monorail system comprising:

a monorail having a plurality of stations thereon;

a source of power on said monorail;

a system controller having a first radio frequency ethernet communications device; and at least one vehicle moving on said monorail among said plurality of stations, said at least one vehicle comprising:

a drive motor connected to said power for moving said vehicle on said monorail;

a remote controller connected to said drive motor for controlling said movement of said vehicle, said remote controller further receiving information from said system controller; and a second radio frequency ethernet communications device interconnected to said remote controller, said second radio frequency ethernet communications device and said first radio frequency ethernet communications device of said system controller forming a wireless ethernet network including at least said system controller and said remote controller in said at least one vehicle;

a remote device connected to said remote controller, said remote device configured to perform a predetermined task at one of said plurality of stations on said monorail before moving on said monorail to perform another predetermined task at another one of said plurality of stations, said information from said system controller delivered over said wireless ethernet network to said at least one vehicle for instructing said at least one vehicle in said controlled movement on said monorail.

2. The monorail system, as claimed in claim 1, further comprising:

at least one positioning marker attached to said monorail; and a reader connected to said remote controller for sensing said at least one positioning marker as said at least one vehicle moves on said monorail past said at least one positioning marker.

3. The monorail system, as claimed in claim 1, further comprising:

at least one radio frequency marker attached to said monorail; and a radio frequency receiver attached to said at least one vehicle for reading said radio frequency marker as said vehicle passes said radio frequency marker.

4. The monorail system, as claimed in claim 1, further comprising:

a collision avoidance system having at least one sensor connected to said remote controller in said at east one vehicle.

5. The monorail system, as claimed in claim 4, wherein said at least one sensor comprises an infrared sensor.

6. A monorail system comprising:

a monorail having a plurality of stations thereon;

a source of power on said monorail;

a system controller having a first radio frequency ethernet communications device;

at least one location marker attached to said monorail; and at least one vehicle moving on said monorail among said plurality of stations, said at least one vehicle comprising:

a motor drive system connected to said power for moving said vehicle on said monorail;

a remote controller interconnected to said motor drive system for controlling movement of said vehicle and for receiving information from said system controller;

a reader connected to said remote controller for sensing said at least one location marker attached to said monorail;

a remote device connected to said remote controller, said remote device configured to perform a predetermined task at one of said plurality of stations on said monorail when said at least one location marker is sensed before moving on said monorail to perform another predetermined task at another one of said plurality of stations; and a second radio frequency ethernet communications device connected to said remote controller, said radio frequency ethernet communications device wirelessly communicating with said first radio frequency ethernet communications device on said system controller to create a wireless ethernet network including at least said system controller and said remote controller, said information from said system controller delivered over said wireless ethernet network to said at least one vehicle for instructing said at least one vehicle in said controlled movement on said monorail.

7. The monorail system, as claimed in claim 6, wherein said location marker comprises a radio frequency transponder.

8. The monorail system, as claimed in claim 7, wherein said radio frequency transponder comprises a passive radio frequency transponder.

9. The monorail system, as claimed in claim 7, wherein said radio frequency transponder comprises an active radio frequency transponder.

10. The monorail system, as claimed in claim 6, wherein said location marker comprises:

a device containing information wherein said information includes an ASCII character string, wherein said ASCII character string translates into a number.

11. A monorail system comprising:

a monorail having a plurality of stations thereon;

a source of power on said monorail;

a system controller having a first radio frequency ethernet communications device;

at least one location marker attached to said monorail, said at least one location marker comprising a radio frequency transponder including a numeric data string; and at least one vehicle moving on said monorail among said plurality of stations, said at least one vehicle comprising:

a motor drive system connected to said power for moving said vehicle on said monorail;

a remote controller interconnected to said motor drive system for controlling movement of said vehicle and for receiving information from said system controller;

a reader connected to said remote controller for sensing said at least one location marker attached to said monorail, said reader comprising a tuned antenna;

a remote device connected to said remote controller, said remote device configured to perform a predetermined task at one of said plurality of stations on said monorail when said at least one location marker is sensed before on said monorail to perform another predetermined task at another one of said plurality of stations; and a second radio frequency ethernet communications device connected to said remote controller, said radio frequency ethernet communications device wirelessly communicating with said first radio frequency ethernet communications device on said system controller to create a wireless ethernet network including at least said system controller and said remote controller, said information from said system controller delivered over said wireless ethernet network to said at least one vehicle for instructing said at least one vehicle in said controlled movement on said monorail.

12. A monorail system comprising:

means for defining a path of movement having a plurality of stations thereon;

a source of power on said means for defining a path of movement;

means for controlling said monorail system having a first means for wirelessly transmitting via an ethernet network;

at least one means for moving along said path of movement among said plurality of stations, said means for moving comprising:

means for propelling said means for moving on said path of movement, said means for propelling connected to said power;

means for remotely controlling connected to said means for propelling, said means for remotely controlling commanding movement of said means for moving and receiving information from said means for controlling;

a remote device connected to said means for remotely controlling, said remote device configured to perform a predetermined task at one of said plurality of stations before moving to another one of said plurality of stations to perform another predetermined task; and second means for wirelessly communicating interconnected to said means for remotely controlling, said second means for wirelessly communicating and said first means for wirelessly communicating forming a wireless ethernet network including at least said means for controlling and said means for remotely controlling in said at least one means for moving, said information from said means for controlling delivered over said wireless ethernet network to said means for moving for instructing said at least one means for moving in said controlled movement on said path of movement.

13. The monorail system, as claimed in claim 12, further comprising:

means for demarking zones along said path of movement connected to said means for remotely controlling.

14. The control system, as claimed in claim 12, further comprising:

means for sensing a location means connected to said means for remotely controlling, said location means attached to said monorail and identifying vehicle movement zones.

15. The control system, as claimed in claim 12, further comprising:

means for detecting obstacles connected to said means for remotely controlling; and means for avoiding a collision with said obstacles connected to said means for remotely controlling.

16. A method for controlling at least one vehicle along a monorail having a system controller and having a plurality of stations thereon, said method comprising the steps of:

assigning a unique ethernet address to said at least one vehicle on said monorail;

selectively transmitting at least one instruction from said system controller to said at least one vehicle via a wireless ethernet network, said transmitted instruction containing said unique ethernet address;

receiving said selectively transmitted at least one instruction at said at least one vehicle having said unique ethernet address;

storing said at least one received instruction in memory on said vehicle having said unique ethernet address; and performing a predetermined task based on said stored instruction before moving on said monorail to another of said plurality of stations to perform another predetermined task.

17. The method, as claimed in claim 16, further comprising the step of:

transmitting a confirmation command from said at least one vehicle having said unique ethernet address to said system controller over said wireless ethernet network, said confirmation command containing said unique ethernet address.

18. The method, as claimed in claim 16, wherein performing said stored instruction further comprises the steps of:

sensing a location marker attached to said monorail, said location marker having a unique location string;

comparing said location string with said at least one instruction wherein said at least one instruction comprises an instruction set having a plurality of instructions each instruction having a unique identifier;

executing a specific instruction from said plurality of instructions in said instruction set wherein said executed specific instruction has an identifier correlated to said unique location string.

19. The method, as claimed in claim 16, further comprising the steps of:

identifying an obstacle in a movement path of said vehicle; and avoiding a collision with said obstacle.

20. The method, as claimed in claim 19, wherein avoiding a collision step further comprises the steps of:

first sensing said obstacle within at least about three meters of said vehicle;

first instructing said vehicle to move at a first predetermined velocity;

second sensing said obstacle within at least about one meter of said vehicle; and second instructing said vehicle to stop moving.

21. A method for controlling at least one vehicle along a monorail having a system controller, said method comprising the steps of:

assigning a unique ethernet address to said at least one vehicle on said monorail;

selectively transmitting at least one instruction from said system controller to said at least one vehicle via a wireless ethernet network, said transmitted instruction containing said unique ethernet address;

receiving said selectively transmitted at least one instruction at said at least one vehicle having said unique ethernet address;

storing said at least one received instruction in memory on said vehicle having said unique ethernet address;

performing said stored instruction, said performing step comprising:

sensing a location marker attached to said monorail, said location marker having a unique location string;

comparing said location string with said at least one instruction wherein said at least one instruction comprises an instruction set having a plurality of instructions each instruction having a unique identifier;

executing a specific instruction from said plurality of instructions in said instruction set wherein said executed specific instruction has an identifier correlated to said unique location string; and transmitting a confirmation command from said at least one vehicle having said unique ethernet address to said system controller over said wireless ethernet network, said confirmation command containing said unique ethernet address;

identifying an obstacle in a movement path of said vehicle; and avoiding a collision with said obstacle, said avoiding step comprising:

first sensing said obstacle within at least about three meters of said vehicle;

first instructing said vehicle to move at a first predetermined velocity;

second sensing said obstacle within at least about one meter of said vehicle; and second instructing said vehicle to stop moving.

* * * * *